US011035630B2

(12) United States Patent
Berief

(10) Patent No.: US 11,035,630 B2
(45) Date of Patent: Jun. 15, 2021

(54) COOLING DEVICE FOR REDUCING THE TEMPERATURE OF COOKED WARM FOOD HELD IN A CONTAINER, IN PARTICULAR IN A STANDARD TROLLEY

(71) Applicant: Theodor W. Berief, Wadersloh (DE)

(72) Inventor: Theodor W. Berief, Wadersloh (DE)

( * ) Notice: Subject to any disclaimer, the term of this patent is extended or adjusted under 35 U.S.C. 154(b) by 0 days.

(21) Appl. No.: 15/550,771

(22) PCT Filed: Feb. 17, 2016

(86) PCT No.: PCT/EP2016/053357
§ 371 (c)(1),
(2) Date: Aug. 12, 2017

(87) PCT Pub. No.: WO2016/131869
PCT Pub. Date: Aug. 25, 2016

(65) Prior Publication Data

US 2018/0038662 A1 Feb. 8, 2018

(30) Foreign Application Priority Data

Feb. 20, 2015 (DE) ..... 20 2015 100 832.5

(51) Int. Cl.
*F28G 1/16* (2006.01)
*F25D 31/00* (2006.01)
(Continued)

(52) U.S. Cl.
CPC ..... *F28G 1/166* (2013.01); *F25D 31/003* (2013.01); *F28D 1/0213* (2013.01);
(Continued)

(58) Field of Classification Search
CPC . F28D 7/12; F28D 1/0213; F28G 1/16; F28G 1/166
See application file for complete search history.

(56) References Cited

U.S. PATENT DOCUMENTS 690,795 A * 1/1902 Thwaite ..... F28G 1/12 165/95
3,653,432 A * 4/1972 Schmid ..... C30B 11/00 117/83
(Continued)

FOREIGN PATENT DOCUMENTS

AT 12 197 U1 12/2011
DE 102 28 440 A1 1/2004
(Continued)

OTHER PUBLICATIONS

International Search Report (dated Jun. 16, 2016) for corresponding International App. PCT/EP2016/053357.

*Primary Examiner* — Eric S Ruppert
(74) *Attorney, Agent, or Firm* — WRB-IP LLP

(57) ABSTRACT

A cooling device for reducing the temperature of cooked warm food in a liquid or paste-like state held in a container, in particular in a standard trolley, is provided. The cooling device includes a plate-like covering member which covers the opening cross-section of the container or of the standard trolley, wherein the covering member has vertically arranged cooling elements on the lower face thereof, which cooling elements, when the cooling device is attached and lowered, are immersed in the density of the food and a cooling medium circulates through the cooling elements, which cooling medium extracts the stored heat from the food. A stripping plate designed as a perforated sheet or as a perforated plate is provided on the lower face of the covering member, which stripping plate removes remaining food from the cooling elements during withdrawal of the cooling device.

13 Claims, 7 Drawing Sheets

(51) Int. Cl.

| | |
|---|---|
| ***F28D 7/12*** | (2006.01) |
| ***F28D 1/02*** | (2006.01) |
| ***F28D 1/053*** | (2006.01) |
| ***F28G 1/08*** | (2006.01) |
| *F28D 21/00* | (2006.01) |

(52) U.S. Cl.
CPC ..... *F28D 1/05341* (2013.01); *F28D 7/12* (2013.01); *F28G 1/08* (2013.01); *F25D 2400/38* (2013.01); *F28D 2021/0042* (2013.01)

(56) References Cited

U.S. PATENT DOCUMENTS

| | | | | | |
|---|---|---|---|---|---|
| 4,170,240 | A * | 10/1979 | Gentry | B08B 3/02 | 134/104.4 |
| 4,569,388 | A * | 2/1986 | Weitman | B01D 5/0012 | 122/379 |
| 5,186,240 | A * | 2/1993 | Kennon | F28G 3/166 | 134/172 |
| 6,283,068 | B1 * | 9/2001 | Kamikozuru | F28F 9/0234 | 122/32 |
| 2002/0117191 | A1 * | 8/2002 | Krenzel | B08B 3/026 | 134/104.1 |
| 2008/0000620 | A1 * | 1/2008 | Tao | F28D 7/12 | 165/95 |
| 2009/0308567 | A1 * | 12/2009 | Meier | F28D 1/0213 | 165/47 |
| 2012/0216843 | A1 * | 8/2012 | Kruger | C02F 1/325 | 134/167 R |
| 2015/0136377 | A1 * | 5/2015 | Kallesoe | F24D 5/04 | 165/214 |

FOREIGN PATENT DOCUMENTS

| | | | | |
|---|---|---|---|---|
| DE | 10 2011 106364 | A1 | | 11/2012 |
| EP | 2 810 566 | A1 | | 12/2014 |
| FR | 1 413 059 | A | | 10/1965 |
| JP | S60 122101 | U | | 8/1985 |
| JP | 2004198030 | A | * | 7/2004 |
| JP | 2004 337128 | A | | 12/2004 |
| JP | 2004347173 | A | * | 12/2004 |

* cited by examiner

COOLING DEVICE FOR REDUCING THE TEMPERATURE OF COOKED WARM FOOD HELD IN A CONTAINER, IN PARTICULAR IN A STANDARD TROLLEY

BACKGROUND AND SUMMARY

The invention relates to a cooling device for reducing the temperature of cooked, warm food held in a container, in particular in a standard trolley in the liquid or pasty state, comprising a plate-like covering body which covers the opening cross section of the container or of the standard trolley, wherein the covering body comprises cooling elements arranged vertically on its lower side which enter in the placed, arrived state of the cooling device into the volumetric mass of the food and a cooling medium circulates through the cooling elements which removes the stored heat from the food.

There is the need in the food industry and in catering to efficiently and rapidly cool down liquid as well as pasty products. This brings it about that the heated foods or products must be cooled down for further processing. Flexibility, hygiene and low product loss as well as very little damage to products have an extremely high priority here. In this context, there is a large weak point in the preproduction of liquid products in a batch process. Existing systems are economical only in the case of large amounts and do not have sufficient flexibility. Considerable product damage and associated quality losses also occur. Frequently, the emptying of remainders is insufficient and the cleaning expense is very high and therefore not environmentally friendly because there is a large consumption of energy and of water. The high use of cleaning agents stresses not only the environment but also increases the expenses.

In the method known in the prior art for cooling cooked or fermented food in pasty or liquid form that are heated in a boiler, they are transferred into a so-called standard trolley which has a holding capacity of 200 to 300 liters. In order to cool the food down from the cooking temperature the filled standard trolleys with the heated food are moved into a cooling chamber. During the cooling down of the food in a cooling chamber it is considered disadvantageous that as a consequence of the formation of steam, ice forms on the heat exchangers, wherein in particular the cooling of the heated food does not reach into the center of the mass to be cooled, so that bacteria can form even though the appropriate, desired cooling temperature was already reached by the walls and also by the surface.

An important problem in such known cooling devices is that after the cooling process the cooling element must be drawn out of the cooled food again which is present in the liquid or pasty state in order to free the cooling device for another standard trolley in this manner. It is especially important here that the cooling rods are cleaned for being used for another cooling, in particular to prevent in this manner that contaminants enter into the next batch. In addition, it is also important that no bacteria form on the cooling rods as a result of the cleaning process.

Therefore, the invention has the problem of further developing a cooling device for reducing the temperature of cooked, warm food held in a container, in particular a standard trolley, in liquid or in pasty form in such a manner that in particular after the cooling process the cooling rods or the cooling elements can be reused for another cooling process.

This problem is solved in accordance with the invention by the features of Claim 1. Advantageous further developments of the invention result from the subclaims.

The problem is solved according to the invention in that a brushing-off plate constructed as a perforated sheet or as a perforated plate is provided on the bottom of the covering body and which removes food remnants from the cooling elements when the device is drawn out. According to a further development, the brushing-off plate is arranged in a frame structure formed by tubes and which is equipped with a spray for cleaning the cooling elements. This construction brings it about that cooling elements are quasi brushed off when drawn out.

The frame structure consists of or comprises here a lower and of an upper tube grid superimposed on one another. The individual tube grid consists of or comprises for its part a rotary tube frame in which tube sections with the nozzle openings are arranged parallel to each other. The upper tube grid is pivotably arranged here on the lower tube grid, wherein the tube sections of the lower tube grid are arranged running transversely to each other to the tube sections of the upper tube grid. This construction brings it about that the perforated sheet or even the perforated plate is integrated between these two pivotably arranged tube grids so that a mechanical brushing-off takes place by the brushing-off plate here, wherein a spraying and wetting with water around the jacket circumference of the individual cooling elements can take place by the upper and the lower tube grid with the tube sections arranged transversely to each other. In this manner an inlet and a runoff for a cleaning medium are provided on the tube frames.

The brushing-offplate is additionally perforated here by conduits ending in the hole area for supplying cleaning steam in at the hole circumference. This results in a double cleaning which on the one hand acts directly on the jacket of the individual cooling element in that the cleaning steam directly acts on the individual cooling element on the hole circumference in the brushing-off plate, wherein the tube sections which are arranged in parallel act here transversely to each other in two planes and also additionally provide a post-washing.

In order to carry out the cooling, conduits are arranged in the covering body which have an active connection to the cooling elements fastened on the surface, and wherein the covering body comprises at least two levels with the conduits, which make available a preliminary run and a return run of the cooling medium for the cooling elements. According to an especially advantageous design of the supplying of the cooling elements with the cooling medium, the preliminary run and the return run are integrated in the primary circuit which for its part has an active connection to a secondary circuit for regulating the cooling temperature. In order to regulate the cooling temperature in the primary circuit at least one thermometer is provided in one of the cooling elements which has an active connection to the secondary circuit for regulating. The thermometer, which detects the temperature of the food to be cooled, is provided here in the center of the cooling elements arranged on the covering body so that in particular the temperature in the core of the food is detected which prevails in the center of the volumetric mass.

For the regulating, the primary circuit is connected here to the secondary circuit by a three-two-way valve. The two cooling circuits have an active connection by the three-two-way valve. To this end cold medium is appropriately supplied into the primary circuit for a regulated cooling down, namely via the three-two-way valve so that a controlled cooling down takes place. To this end, when measuring the temperature on the cooling element the regulating is appropriately carried out via the primary circuit so that the gradually controlled cooling down can take place via the secondary circuit. In order to better detect in particular the cooling-down temperature, thermometers and regulators are additionally present in the primary circuit in the supply line and in the runoff line so that the cooling process or the cooling down process can be completed here in a moderate manner.

The cooling medium circulating out of the primary circuit is pumped here through the individual cooling elements in such a manner that the cooling medium flows through the double-wall tube of the cooling element and the cooling medium is supplied via the annular space between the inner tube and the outer tube and is returned through the inner tube.

The cooling device as such cooperates here with a stroke device by which either a lowering of the cooling elements into the standard trolley or a raising of the standard trolley for the removal of the cooling elements takes place.

In the cooling system according to the invention lances are moved into a filled container or standard trolley. The individual lance is a double-wall tube, wherein a second tube with a smaller diameter is inserted in the outer tube. A cooling liquid such as, e.g., water, ice water, saline water, glycol or the like circulates through the intermediate spaces of the two tubes. The tubes are held by high-grade steel plates and are inserted into each other. Appropriate chambers for the preliminary run and the return run of the cooling medium ensure a uniform distribution of pressure and therefore uniform flows in the lances. The corresponding heat exchanger surface is significantly larger than in a cooling boiler. Even the wall thickness is significantly thinner than in a cooling boiler, which elevates the transfer of heat. A distribution of the heat during the cooling can be elevated in that the lances are moved out vertically or area reintroduced at certain intervals. The vertical movement for the entering process is carried out by a stroke device.

The cooling system according to the invention has the special advantage that no pump delivers the food to be cooled through tube lines, which would only result in damage to the product. Furthermore, there are no hidden corners and edges in the system in which bacteria can form. Furthermore, cross contaminations by a further filling of a cooling boiler are excluded. A special advantage is that a low cleaning expense is necessary. In addition, low product losses are present because an easy batch change is given. It is also advantageous that during the cooling there is no damage to the product.

The invention suggests in accordance with its features that the device for cooling can be inserted into the warm food in the standard trolley, wherein a cooling medium circulates through the device which brings about a uniform, homogeneous reduction of the stored heat over the massive volume of the food stored in the standard trolley.

According to an advantageous embodiment of the invention the device consists of or comprises a plate-like covering body which completely covers the cross section of the opening of the container and here in particular the cross section of the opening of the standard trolley. The covering body advantageously comprises vertically standing cooling elements on its bottom here which enter in the placed state of the device into the volumetric mass to be cooled. This construction brings it about that the cooling elements enter into a direct contact with the warm food over the entire volume of the food to be cooled so that, based on this embodiment, an effective removal of heat is achieved, wherein the cooling also takes place in a corresponding manner in the core area of the food. This has the result that no residual germs can form and no undesirable post-fermentation effects are produced.

According to an especially advantageous embodiment of the invention conduits are arranged in the covering body which communicate with the cooling elements fastened on the surface. The covering body comprises at least two levels with conduits here which make available a preliminary run and a return run for the cooling means through the cooling elements. In a further development of the cooling elements they are distributed arranged over a surface pattern on the bottom of the covering body and preferably over a rectangular surface here. It is of course understood that when using a round container or a round standard trolley even the cooling elements are arranged in a corresponding manner on the bottom of the covering body on a circular surface.

In a further development the individual cooling element comprises a double-wall tube, wherein the cooling medium is supplied via the annular space extending between the inner tube and the outer tube and is returned through the inner tube. Therefore, a circuit of the cooling means results which makes a cooling down of the heated food available rapidly and efficiently. The inverse flowthrough is also possible.

According to another embodiment of the cooling elements the individual cooling element here can also consist of or comprises a preliminary run tube and of a return run tube which are connected at their lower ends by a tube arc.

According to an especially advantageous embodiment of the invention a brushing-off plate designed as a perforated sheet is provided on the bottom of the covering body and which removes food remnants from the cooling element during the drawing out of the device. It is of course understood than when the lances or the tubes are drawn out of the cooled food mass, the brushing-off plate remains lying on the cross section of the opening of the standard trolley, wherein the food remnants can then also be scraped off here on the bottom of the brushing-off sheet. To this end, rubberized ring seals are provided in particular in the openings of the perorated sheet which make possible a clean removal.

BRIEF DESCRIPTION OF THE DRAWINGS

An exemplary embodiment of the invention is shown in a purely schematic manner in the drawings and is described in detail in the following. In the drawings.

DETAILED DESCRIPTION

Figure 1:
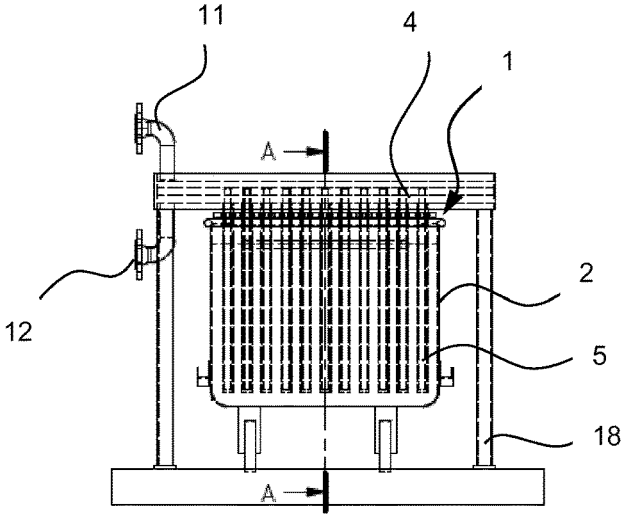
FIG. 1 shows a front elevation of front view of the cooling device in the standard trolley with the stroke device.
Figure 2:
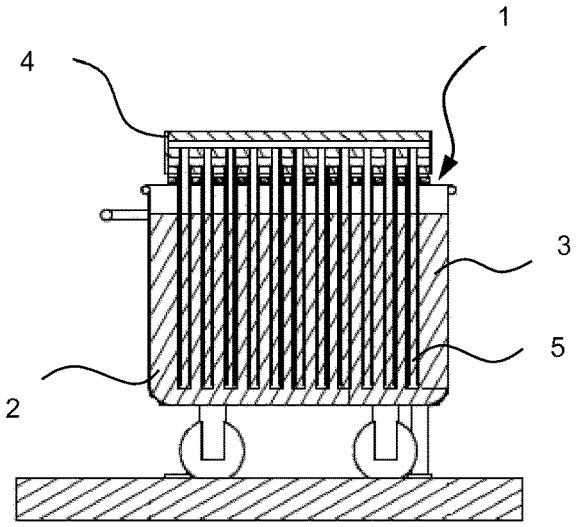
FIG. 2 shows a sectional side view of the cooling device in the standard trolley according to the sectional line A-A in FIG. 1.

FIGS. 1 and 2 show a cooling device on the one hand in a front view and on the other hand in a sectional side view for reducing the temperature of warm food 3 held in a container, in particular in a standard trolley 2 in liquid or pasty form. The device 1 for the cooling is inserted into the warm food 3, wherein a cooling medium circulates through the device 1 which brings about a uniform, homogenous reduction of the stored heat over the massive volume of the food 3 stored in the standard trolley 2. To this end, a cooling means is supplied which is then introduced via the device 1 into the heated food 3. The device 1 extends here over the upper opening cross section off the standard trolley 2 and covers it. The device comprises here a covering body 4 which comprises vertically arranged cooling elements 5 on its bottom and which are inserted in the placed state of the device 1 into the volumetric mass of the food 3, as is shown in particular in the FIGS. 1 and 2. This situation is also shown in particular in FIG. 4, where in particular the cooling elements 5 enter into the food 3 in an exposed view.

Figure 4:
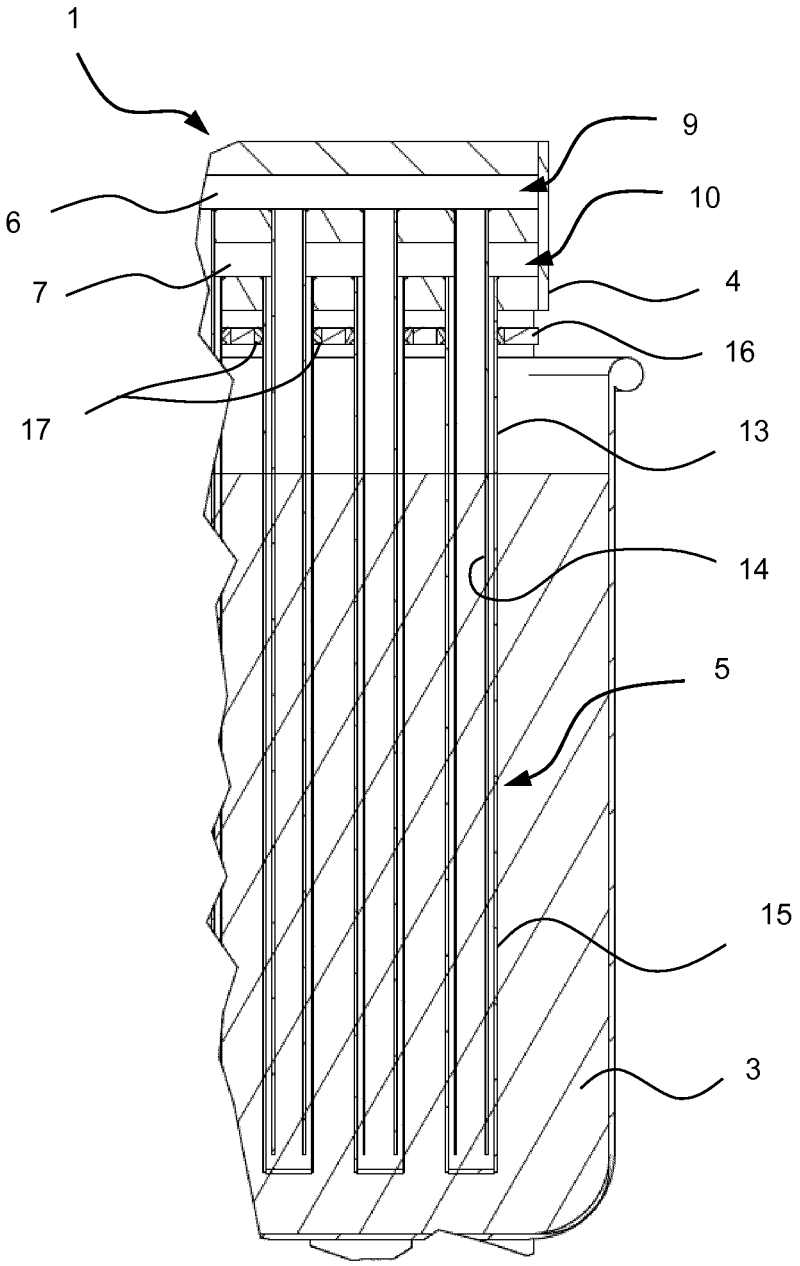
FIG. 4 shows a sectional detailed review in a side view of the cooling device with the plate-like covering body and cooling elements.

As can be clearly recognized in particular from viewing FIGS. 1, 2 and 4 together, conduits 6 and 7 are arranged in the brushing-off body 4 which communicate with the cooling elements 5 fastened on the surface 8. As can be recognized especially from FIG. 4 in a detailed view, the cooling body 4 comprises at least two levels 9 and 10 with the conduits 6 and 7, wherein the level 10 makes the preliminary run available and the other level 9 makes the return run of the cooling means for the cooling elements 7 available. As can be recognized in particular from FIG. 4 in particular the lower level 10 here—and here the conduit 7—are constructed as a preliminary run, wherein the level 9 with the conduits 6 forms the return run here. These conduits 6 and 7 are connected in a corresponding manner to flange connections 11 and 12—shown in FIG. 1 so that the supply of cooling agent can be appropriately connected to them. The preliminary run and the return run can also be exchanged for a functioning system.

Figure 3:
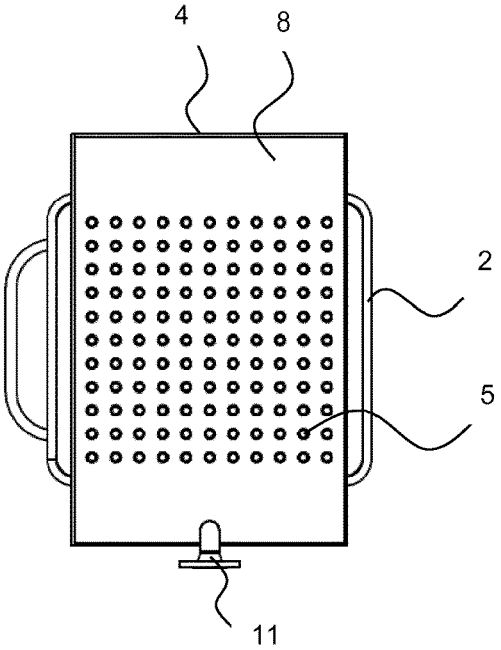
FIG. 3 shows a top view onto the cooling device.

In a further development of the device 1 the cooling elements 5 are arranged on the covering body 4 via a surface grid 8 on the bottom of the covering body 4, preferably over a rectangular surface, as can be recognized in particular in FIG. 3. It is of course understood here that if, for example, a round standard trolley 2 is used here, the surface pattern must also be designed to be round. It can be recognized in FIG. 4 that the individual cooling element 5 comprises a double-wall tube, wherein the cooling medium is supplied via the annular space extending between the inner tube in the outer tube and is returned through the inner tube. This brings it about that the cooling medium receives heat over the entire tube circumference in the tube 3 and therefore the heat can be removed from the entire massive volume of the food 3.

According to another embodiment of the cooling elements 5 they can also consist of or comprises individual preliminary tubes and return tubes which are connected at their lower ends to a tube arc. In this manner the cooling medium is introduced via a preliminary tube into the food 3, wherein the heat is then removed via the adjacent return tube. As a result of a large volumetric flow and of a low calculated temperature difference the removal of heat acts over the total tube length present in the product.

In a further development of therefore invention a brushing-off plate 16 constructed as a perforated sheet is provided on the bottom of the covering body 6 and which removes food remnants from the cooling elements 5 when they are drawn out of the device 1. It is now conceivable than when the covering body 4 with the cooling elements 5 is drawn out of the food volume, the food remnants clinging to the outer tube 15 are brushed off on the perforated sheet 16, wherein in order to improve the brushing-off process even more, in particular rubberized ring seals 17 are provided in the individual holes of the brushing-off plate 16.

In order to use in particular the device 1 in a simple and rapid manner, it cooperates with a stroke device 18 by which either a lowering of the cooling elements 5 into the standard trolley 2 or a raising of the standard trolley 2 to receive the cooling elements 5 takes place.

Figure 5:
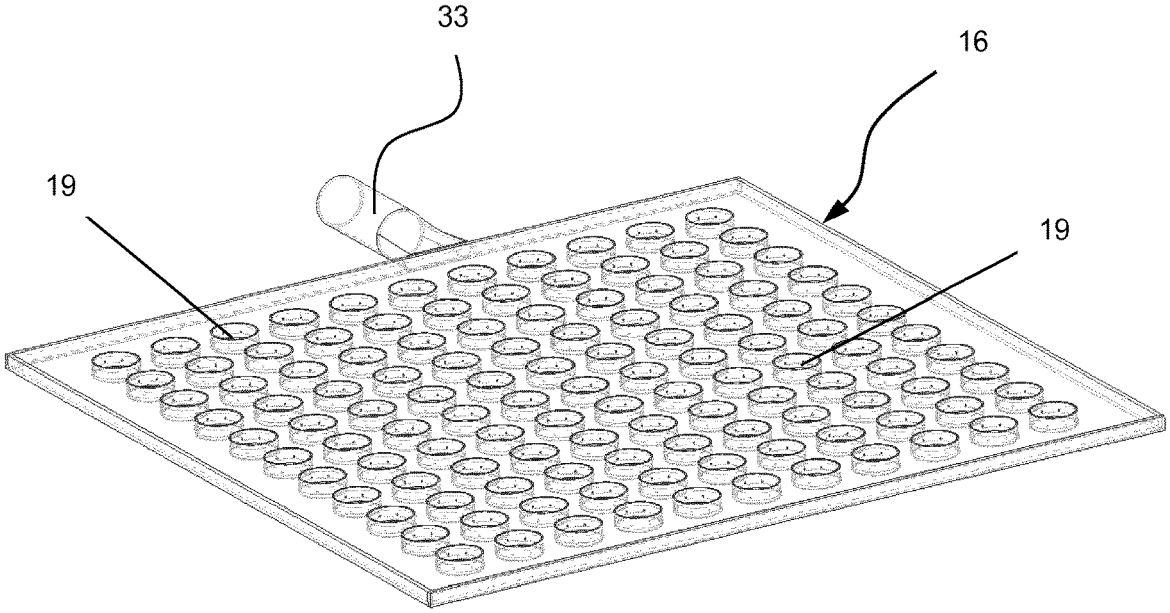
FIG. 5 shows a perspective view of a perforated sheet constructed as a brushing-off plate.
Figure 6:
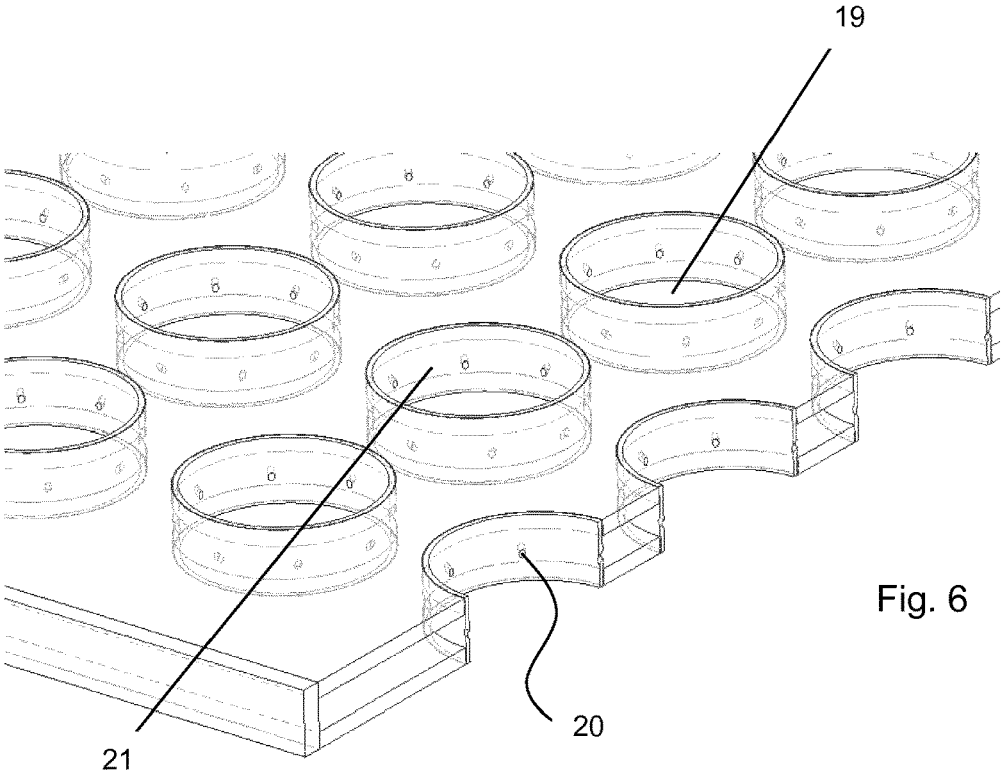
FIG. 6 shows another detailed view of the perforated sheet in a sectional state.

FIGS. 5 and 6 show in individual views the perforated sheet provided on the bottom of the covering body 4 or show brushing-off plate 16 constructed as a perforated plate which removes food remnants from the circumference of the cooling elements 5 during the drawing out of the cooling elements 5. As can be clearly recognized from the FIGS. 5 and 6, the brushing-off plate 16 consists of or comprises perforations 19 through which the individual cooling elements 5 are moved in and out. The individual perforations 19 are dimensioned in such a manner that they rest closely on the jacket of the cooling elements 5 constructed to be round so that a brushing-off effect of the food remnants on the perforated sheet takes place. As can be furthermore recognized from the two figures, the brushing-offplate 16 is perforated by conduits 20 which terminate in the hole edge area 21 of the holes 19 in fine nozzles for feeding in cleaning steam. This can be clearly recognized in particular in FIG. 6 where individual nozzles are arranged distributed over the circumference of the hole edge area 21 so that when the individual cooling element 5 is drawing out of the cooled food, not only a mechanical cleaning takes place on the cooling element 5 but also an additional steaming is carried out which ensures a loosening of the clinging food.

Figure 7A:
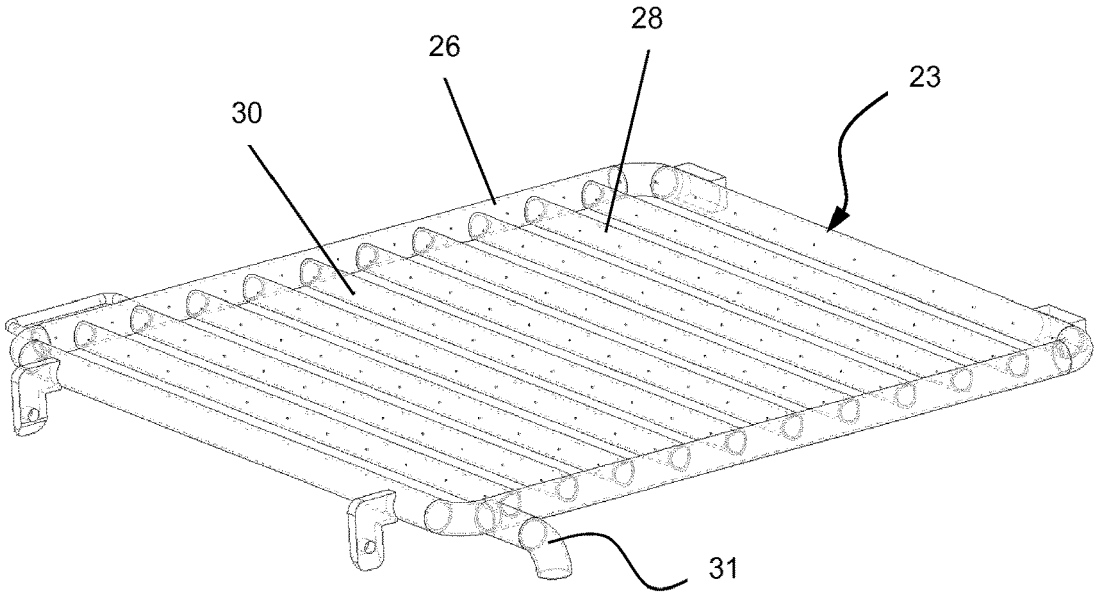
FIG. 7 shows a perspective view of the upper tube grid in 7*a* and a detailed view of the tube sections in 7*b;*
Figure 7B:
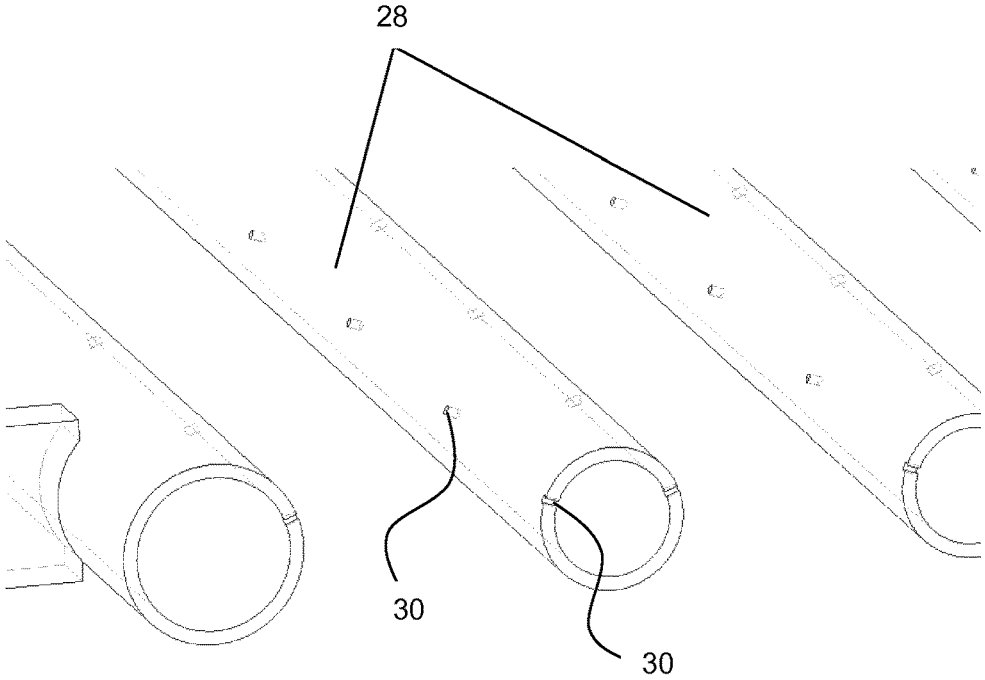
Figure 8A:
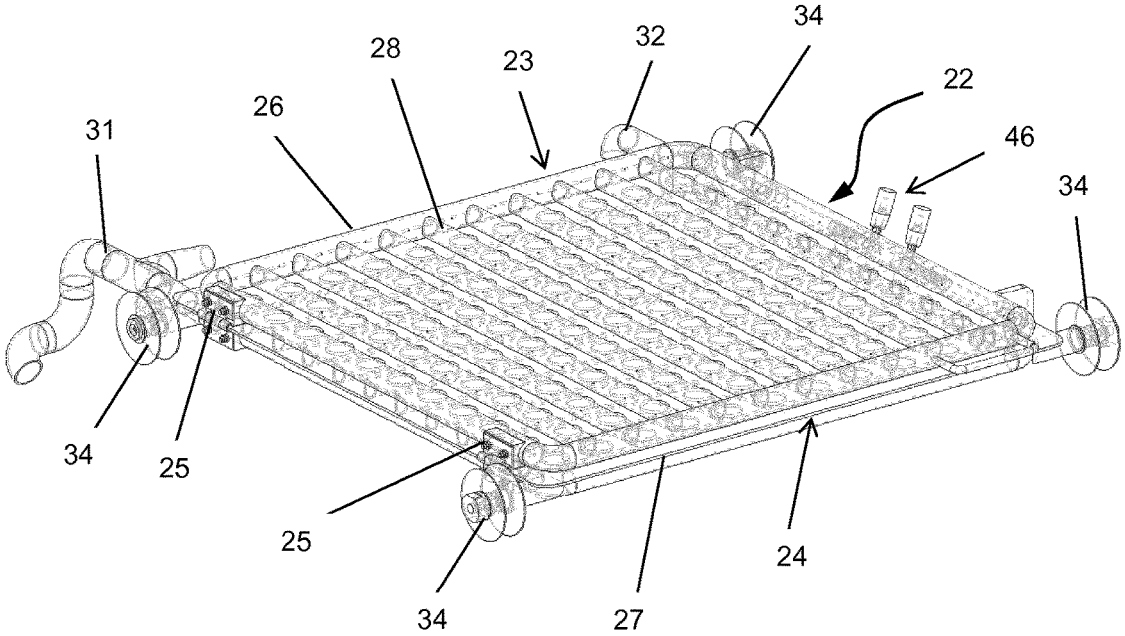
FIG. 8 shows a perspective view of the tube frame structure in the folded-together state in a first view 8*a* and in a second view 8*b;*
Figure 8B:
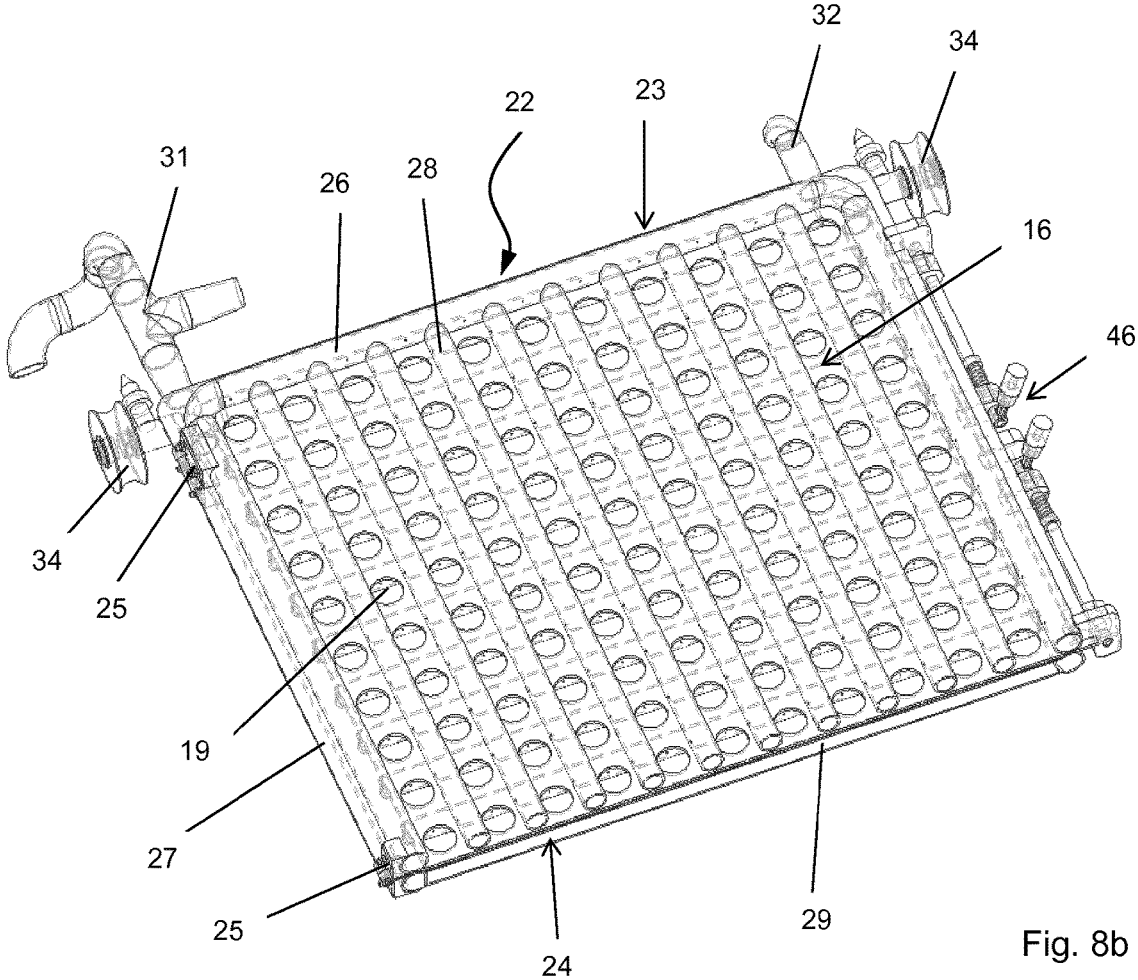
Figure 9:
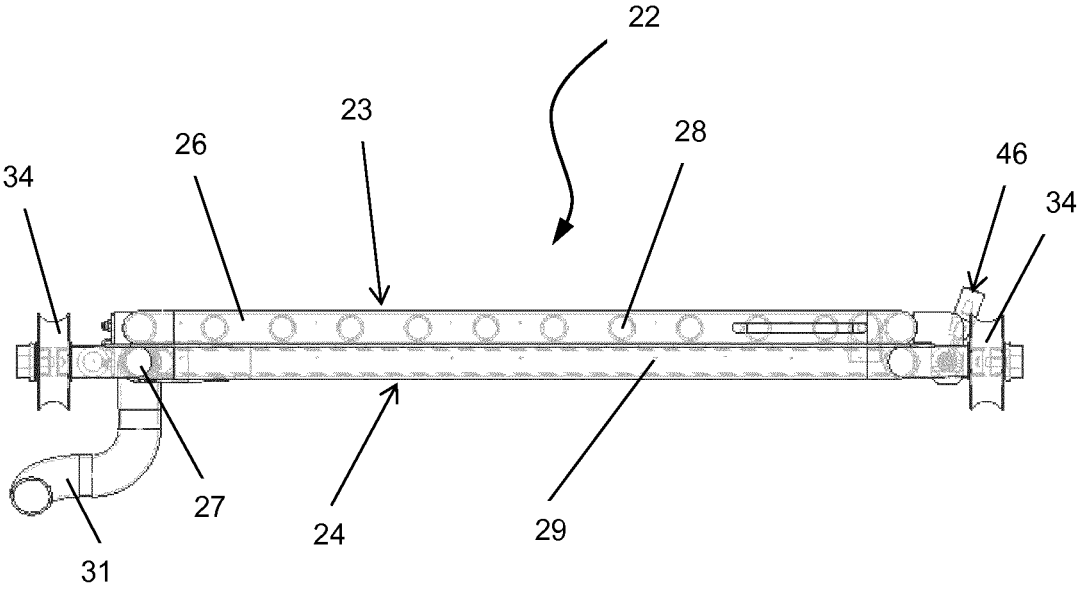
FIG. 9 shows a side view of the frame structure according to FIGS. 7 and 8.

Furthermore, as can be recognized in particular from FIGS. 7, 8 and 9, the brushing-off plate 16 is arranged in a frame structure 22 formed by tubes which is equipped with a spraying arrangement also for cleaning the cooling elements 5. It can be recognized from the three FIGS. 7, 8 and 9 that the frame structure 22 consists of or comprises an upper and a lower tube grid 23 and 24, wherein both tube grids 23, 24 are pivotably connected to one another. To this end hinges 25 are provided on one of the longitudinal sides, as FIG. 8*a* clearly shows; however, they can also be recognized in FIG. 8*b* on the side area of the frame structure 22. As is also apparent from the three figures, the individual tube grid 23, 24 consists of or comprises a circumferential tube frame 26 and 27 in which tube sections 28 and 29 with nozzle openings 30 are arranged parallel to one another, as can be recognized, for example, in the individual view of the FIG. 7*a* of the tube grid 23. The two tube frames 26 and 27 are held together here in the folded-together state by a catch device 46. The brushing off plate in the embodiment shown in FIGS. 8A-8B is perforated by conduits 20 ending in a hole edge area 21 of perforations 19 in the brushing off plate in the same manner as shown in FIG. 6.

As already stated, the upper tube grid 23 is pivotably arranged here on the lower tube grid 24, wherein the tube sections 29 of the lower tube grid 24 are arranged running transversely to each other to the tube sections 28 of the upper tube grid 23. As already explained, the tube sections 28 and 29 comprise nozzle openings 30 here as they are indicated in the detailed view of FIG. 7*b*. They are also indicated in a corresponding manner in FIGS. 8*a* and 8*b*, wherein an inlet and an outlet 31 and 32 for a cleaning medium are provided on the frame structure 22.

Based on the construction and the design of the frame structure 22, the following cleaning device for the cooling elements 5 results, wherein the brushing-off plate 16 is inserted between the two tube grids 23 and 24. A steam producer is connected via the connecting piece 33 which can be seen in FIG. 5 and which makes the cleaning steam available to the nozzles in the hole edge area 21. The connected brushing-off plate 16 is then introduced into the frame structure 23, wherein the two tube grids 23 and 24 are also connected via the inlet and the outlet 31, 32 to a spraying device so that fresh water can be accordingly introduced into the tube grid in order to bring about in this manner a spraying and moistening of the cooling elements 5 when they are drawn out of the cooled-down food.

Figure 10:
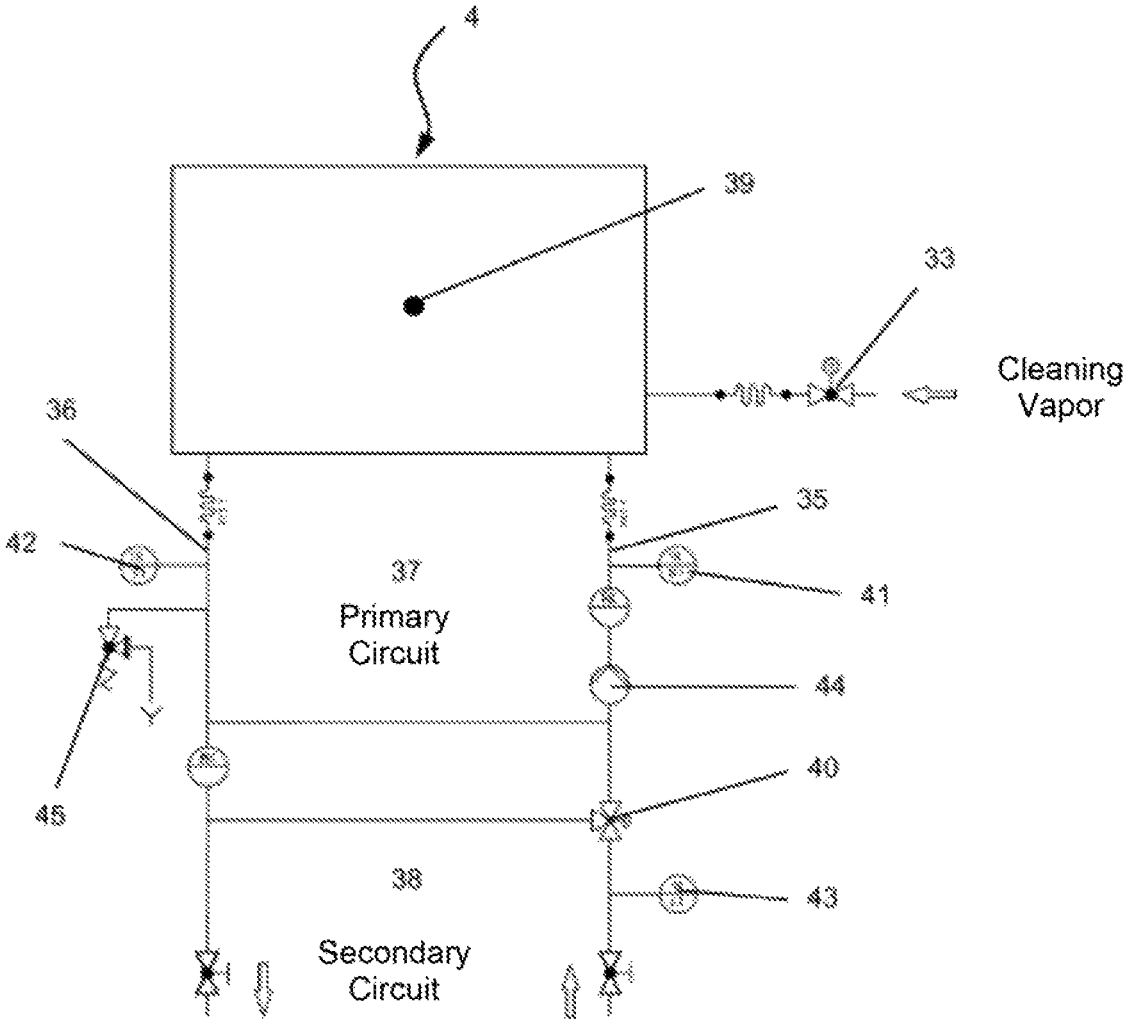
FIG. 10 shows a basic sketch of the regulation of the control for the cooling circuit of the cooling device.

The frame structure 22 as such is designed here to be rollable for a structure which is not shown in detail, wherein rollers 34 are provided on the frame structure 22 so that the cleaning device can be drawn out here from the area of the cooling device 1 in order to clean them. As was already explained above, conduits 6 and 7 are arranged on the covering body 4 which communicate with the cooling elements 5 fastened on the surface. The covering body 4 has two levels 9 and 10 with the conduits 6 and 7 which make available a preliminary run and a return run of the cooling medium for the cooling elements 5. As can be recognized especially from the FIG. 10, a control and regulating device for the cooling elements is shown in it. It can be recognized there that the preliminary run and the return run 35 and 36 are integrated in primary circuit 37, wherein the primary circuit 37 has an active connection with a secondary circuit 38 for regulating the cooling temperature. At least one thermometer 39 for regulating the cooling temperature in the primary circuit 37 is provided in one of the cooling elements 5 which has an active connection with the secondary circuit 38 for the regulation. In particular, the thermometer 39 in the primary circuit 37 is indicated here which has an active connection with the regulating circuit, the secondary circuit 38.

A two-three-way valve 40 is present for regulating the cooling temperature of the primary circuit 37 which valve brings the two circuits 37 and 38 into an active connection with one another. In order to carry out a controlled cooling of the food, the temperature on the thermometer 39, which is present on the cooling elements 5 in the center, is measured, wherein other thermometers 41 and 42 are provided in the primary circuit 37 in the inlet and the runoffof the primary circuit run 37 in order to determine how the temperature is cooling down in the food. In order to achieve a controlled cooling-down, cold medium is appropriately fed into the primary circuit 37 via the two-three-way valve 40 so that the cooling process can be carried out in a controlled manner.

Another thermometer 43 is also provided in the inlet of the secondary circuit 38 here which measures in particular the cooling means temperature in the regulating circuit. The cooling means is kept in circulation by a pump 44 in the primary circuit 37, wherein heated-up cooling medium can be removed via a runoff 45 in the primary circuit 37 in an appropriate manner from the primary circuit 37 by the runoff 45 so that a constant lowering of the food temperature can take place in a controlled manner.

As was already explained, the individual cooling element 5 comprises a double-wall tube here, wherein the cooling medium is supplied via the annular space 13 between the inner tube and the outer tube 14, 15 and is returned through the inner tube 14, wherein the temperature in the food core can then be measured for the primary circuit 37 by the thermometer 39. Based on the temperature difference of the thermometers 41 and 42 between the inlet and the runoff of the primary circuit 37, the regulating can then take place, wherein a cooling agent is appropriately supplied via the secondary run 38 in order to carry out a controlled cooling-down in this manner.

LIST OF REFERENCE NUMERALS

1. Cooling device
2. Container/standard trolley
3. Food
4. Covering body
5. Cooling element
6. Conduits
7. Conduits
8. Surface grid
9. Level
10. Level
11. Flange
12. Flange
13. Annular space
14. Inner tube
15. Outer tube
16. Brushing-off plate/perforated sheet
17. Ring seal
18. Stroke device
19. Holes brushing-offplate
20. Conduits brushing-offplate
21. Hole edge area brushing-offplate
22. Frame structure
23. Upper tube grid
24. Lower tube grid
25. Hinges
26. Tube frame upper tube grid
27. Tube frame lower tube grid
28. Tube sections upper
29. Tube sections lower
30. Nozzle openings
31. Inlet tube grid
32. Runoff tube grid
33. Connecting piece
34. Rollers
35. Preliminary run primary circuit
36. Return run primary circuit
37. Primary circuit
38. Secondary circuit
39. Thermometer cooling element
40. Two-three-way valve
41. Thermometer primary circuit
42. Thermometer primary circuit
43. Thermometer secondary circuit
44. Pump
45. Runoff primary circuit
46. Catch device

The invention claimed is:

1. A cooling device for reducing the temperature of cooked, warm food held in a container, comprising a covering body comprising a plate which covers an opening cross section of the container, wherein the covering body comprises tubular cooling elements attached at first ends thereof on a lower side of the covering body perpendicular to the plate, the cooling elements being freestanding at a second ends thereof and being configured to, when the cooling device is caused to enter into a mass of the food and a cooling medium circulates through the cooling elements, remove stored heat from the food, wherein a brushing-off plate constructed as a perforated member is provided below the covering body and is configured to remove food remnants from the cooling elements when the cooling elements are drawn out of the food, and wherein the cooling elements are movable relative to the container and the brushing-off plate, wherein the brushing-off plate is arranged in a frame structure formed by tubes and the frame structure is equipped with a spraying arrangement for cleaning the cooling elements.

2. The cooling device according to claim 1, wherein the frame structure comprises an upper and a lower tube grid formed by the tubes.

3. The cooling device according to claim 2, wherein the upper and the lower tube grid both comprise tube sections with nozzle openings that are arranged parallel to each other.

4. The cooling device according to claim 3, wherein the upper tube grid is pivotably arranged on the lower tube grid, and wherein tube sections of the lower tube grid are arranged running transversely to tube sections of the upper tube grid.

5. The cooling device according to claim 1, wherein an inlet and an outlet for a cleaning medium are provided on the frame structure.

6. The cooling device according to claim 1, the brushing off plate is perforated by perforations, and the perforations are perforated in edge areas thereof by conduits.

7. The cooling device according to claim 1, wherein conduits are arranged in the covering body and are connected to the cooling elements, and wherein the conduits are disposed on at least two levels, conduits on a first one of the at least two levels forming a preliminary run and conduits on a second one of the at least two levels forming a return run of the cooling medium for the cooling elements.

8. The cooling device according to claim 7, wherein the preliminary run and the return run are integrated in a primary circuit which has an active connection to a secondary circuit for regulating a temperature of the food.

9. The cooling device according to claim 8, wherein at least one thermometer is provided in one of the cooling elements, the one of the cooling elements being connected to the secondary circuit.

10. The cooling device according to claim 8, wherein the primary circuit is connected to the secondary circuit by a two position three-way valve.

11. The cooling device according to claim 1, wherein the cooling elements comprise a double-wall tube, wherein the cooling medium is supplied via an annular space between an inner tube and an outer tube of the double-wall tube and is returned through the inner tube.

12. The cooling device according to claim 1, wherein the brushing off plate is perforated by perforations, and the perforations are perforated in edge areas thereof by conduits.

13. A cooling device for reducing the temperature of cooked, warm food held in a container, comprising a covering body comprising a plate which covers an opening cross section of the container, wherein the covering body comprises tubular cooling elements attached at first ends thereof on a lower side of the covering body perpendicular to the plate, the cooling elements being freestanding at second ends thereof and being configured to, when the cooling device is caused to enter into a mass of the food and a cooling medium circulates through the cooling elements, remove stored heat from the food, wherein a brushing-off plate constructed as a perforated member is provided below the covering body and is configured to remove food remnants from the cooling elements when the cooling elements are drawn out of the food, and wherein the cooling elements are movable relative to the container and the brushing-off plate, wherein the brushing-off plate is arranged in a frame structure formed by tubes and the frame structure is equipped with at least one spray nozzle for cleaning the cooling elements.

* * * * *